US006148700A

United States Patent [19]

Upholz

[11] Patent Number: 6,148,700

[45] Date of Patent: Nov. 21, 2000

[54] SPRING WINDING DEVICE

[76] Inventor: Michael R. Upholz, 35595 #H Curtis Blvd., Eastlake, Ohio 44095

[21] Appl. No.: 09/259,875

[22] Filed: Mar. 1, 1999

Related U.S. Application Data

[60] Provisional application No. 60/076,718, Mar. 4, 1998.

[51] Int. Cl.[7] ..... B25B 11/00

[52] U.S. Cl. ..... 81/486; 81/54

[58] Field of Search ..... 81/486, 54

[56] References Cited

U.S. PATENT DOCUMENTS

| | | | |
|---|---|---|---|
| 1,635,747 | 7/1927 | Folger et al. | 81/486 |
| 4,443,865 | 4/1984 | Schultz et al. | 364/900 |
| 4,505,170 | 3/1985 | Van laere | 81/464 |
| 4,813,123 | 3/1989 | Wilson et al. | 29/593 |
| 5,146,956 | 9/1992 | Burgos et al. | 140/89 |
| 5,369,566 | 11/1994 | Pfost et al. | 364/147 |

FOREIGN PATENT DOCUMENTS

| | | | |
|---|---|---|---|
| 0119-928 | 9/1984 | European Pat. Off. | 81/54 |

*Primary Examiner*—James G. Smith
*Assistant Examiner*—Hadi Shakeri
*Attorney, Agent, or Firm*—James A. Lucas; Driggs, Lucas, Brubaker & Hogg Co., L.P.A.

[57] ABSTRACT

Window sashes such as double hung sashes often are assembled with a counterbalancing mechanism to facilitate the opening and closing of the window. When the sashes are made from vinyl, the counterbalancing of the window is commonly achieved by the use of a pair of coil springs, one mounted within a channel in the sash on either side of the window. A programmable motorized hand tool is used to apply tension quickly to each of the springs thereby improving production rates and quality control while reducing the risks of repetitive motion injury to the person using the hand tool. A programmable stepper controller drives the motor and controls the functions of the hand tool such as the speed and direction of rotation, the number of revolutions and the start-up and operating torques.

21 Claims, 6 Drawing Sheets

SPRING WINDING DEVICE

CROSS REFERENCE TO RELATED APPLICATION

This application claims the benefit under 35 U.S.C. Section 119(e) of provisional application Ser. No. 60/076,718, filed Mar. 4, 1998.

FIELD OF THE INVENTION

This invention relates to a tool useful in applying tension to a coil spring. More particularly, it relates to a hand held tool useful in coiling a helical rod of the type commonly used in connection with vinyl double-hung windows

DISCUSSION OF THE PRIOR ART

The fabrication of double-hung windows has evolved over the years from the use of heavy wooden sashes and window jambs to lightweight aluminum and vinyl sashes and jambs. The earlier windows used heavy iron counterweights in the sashes which were joined to the window sash by a rope passing over a pulley. The counterweights counter balanced the weight of the window thereby keeping the window stationary notwithstanding the pull of gravity.

The more contemporary lightweight sashes have substantially reduced the requirements of the counter-balance, thereby virtually eliminating the need for a heavy counter weight.

In the fabrication of double hung windows using vinyl sashes and jambs, the weight of the windows is typically counter balanced by a balancer spring. The spring comprises an elongated cylindrical tube, open at one end and closed at the other. The closed end is attached to the window sash. Inside the tube is a coil spring with one end fixed to the tube and the other end connected to a first end of a flat helical rod. The rod is twisted into a helix along its length except for a straight section at the second end. A pair of pins extend through the straight section at right angles to the flat surfaces of the rod. One pin at the end of the rod is adapted to be engaged by a tool to apply torque to the coil spring by rotating the rod. The second inner pin is spaced ½" to ¾" from the end pin and engages a slot in a shoe secured to the window jamb.

Heretofore, a hand tool has been used to rotate the helical rod to apply torque thereto. The tool comprises a handle joined to an elongated rod, the end of which is in the shape of a slotted or forked hook. The straight end of the helical rod fits into the slotted hook and the end pin engages each loop of the hook on either side of the rod. The tool is then manually rotated between 2 and 15 revolutions to apply tension to the coil spring, each revolution increasing the amount of tension applied thereto. The tool rod is then manually inserted into the shoe in the jamb to engage the inner pin with a pin holder in the shoe. The same procedure is applied to a corresponding balancer spring on the other side of the window. However, if the two springs are not rotated the same number of times, the spring tensions on the two sides of the window are unequal, thereby causing the window to bind as it moves up and down in the window jamb. These repetitive manual steps frequently contribute to workplace-related injuries such as tendenitis and carpel tunnel syndrome.

SUMMARY OF THE INVENTION

The present invention relates to a device for applying a uniformly reproducible torque on a balance spring. The device comprises a controller, an actuator means such as a foot petal, and a hand tool comprising a motor, a speed reducer and means for engaging one end of the helical rod in a balancer spring and for applying torque to the same. The controller includes a power source, a keypad with a digital display for programming the number of turns or revolutions to be applied to the spring, an input from a foot switch, a toggle switch to impart clockwise or counterclockwise rotation to the balance spring engaging means, a toggle for switching between repeat mode and reprogrammable mode, and a zero reset counter.

One objective of the present invention is to overcome quality control problems associated with the tensioning of balance springs used in the construction and assembly of vinyl double hung windows;

Another objective of the present invention is to reduce the likelihood of work-related injuries caused by repetitive motion;

Still another objective is a more uniform and reproducible procedure for applying a predetermined amount of tension to a coil spring of the type used for counterbalancing windows in double hung window sashes.

These and other objectives which will become apparent from the following disclosure are achieved in the manner to be hereinafter described as follows. The invention comprises a device for delivering a uniformly reproducible number of rotations to a coil spring. The device comprises a hand tool which includes a motor, a speed reducer and means for engaging and turning a free end of a coil spring relative to its fixed end to vary the tension on the spring. The motor preferably comprises a step-motor which has a no-load speed of 3000 r.p.m. The speed reducer typically has a reduction ratio of about 5 to 1. A programmable controller is coupled to the hand tool for controlling the operating parameters of the tool. The controller preferably is a stepper controller which drives the step motor at less than 5000, and preferably less than 1000 microsteps for each revolution of the step motor. The stepper controller preferably includes one or more of the following features: a step-down signal means following a predetermined period of idleness of the hand tool; a means to provide speed degradation of the step motor as the number of programmed revolutions increases; and a means to shut down the hand tool motor at peak current. The device preferably includes means such as a numeric keypad, to impart instructions to the stepper controller relative to the number of revolutions to be applied to the free end of the coil spring. A direction-of-rotation control, and a mode selection control for zero reset or for repeat operation, are also included. The device also includes means such as a foot petal or trigger for activating the hand tool pursuant to the instructions imparted to the controller.

In another aspect of the invention, a programmable device is described for applying tension to a balancer spring assembly of the type used in connection with a double-hung window system. The device comprises a hand tool, a programmable stepper controller coupled to the hand tool and a foot petal to activate the hand tool. The hand tool includes a step-motor having a no load speed of approximately 3000 r.p.m., a speed reducer coupled to the motor and having a reduction ratio of about 5 to 1, a chuck for holding a slotted winder hook, and a winder hook held in the chuck. The stepper controller comprises a numeric keypad for entering a predetermined number of revolutions to be imparted to the winder hook, a rotation direction selector, and a mode selection means to select between zero reset and repeat operation after a given cycle. The stepper controller preferably drives the step motor at less than 1000 microsteps per revolution of the step motor. The stepper controller also preferably includes a step-down signal means following a predetermined period of idleness of the hand tool; a speed degradation of the step motor as the number of programmed revolutions increases; and means to shut down the motor at peak current.

DETAILED DISCLOSURE OF THE INVENTION

Figure 1:
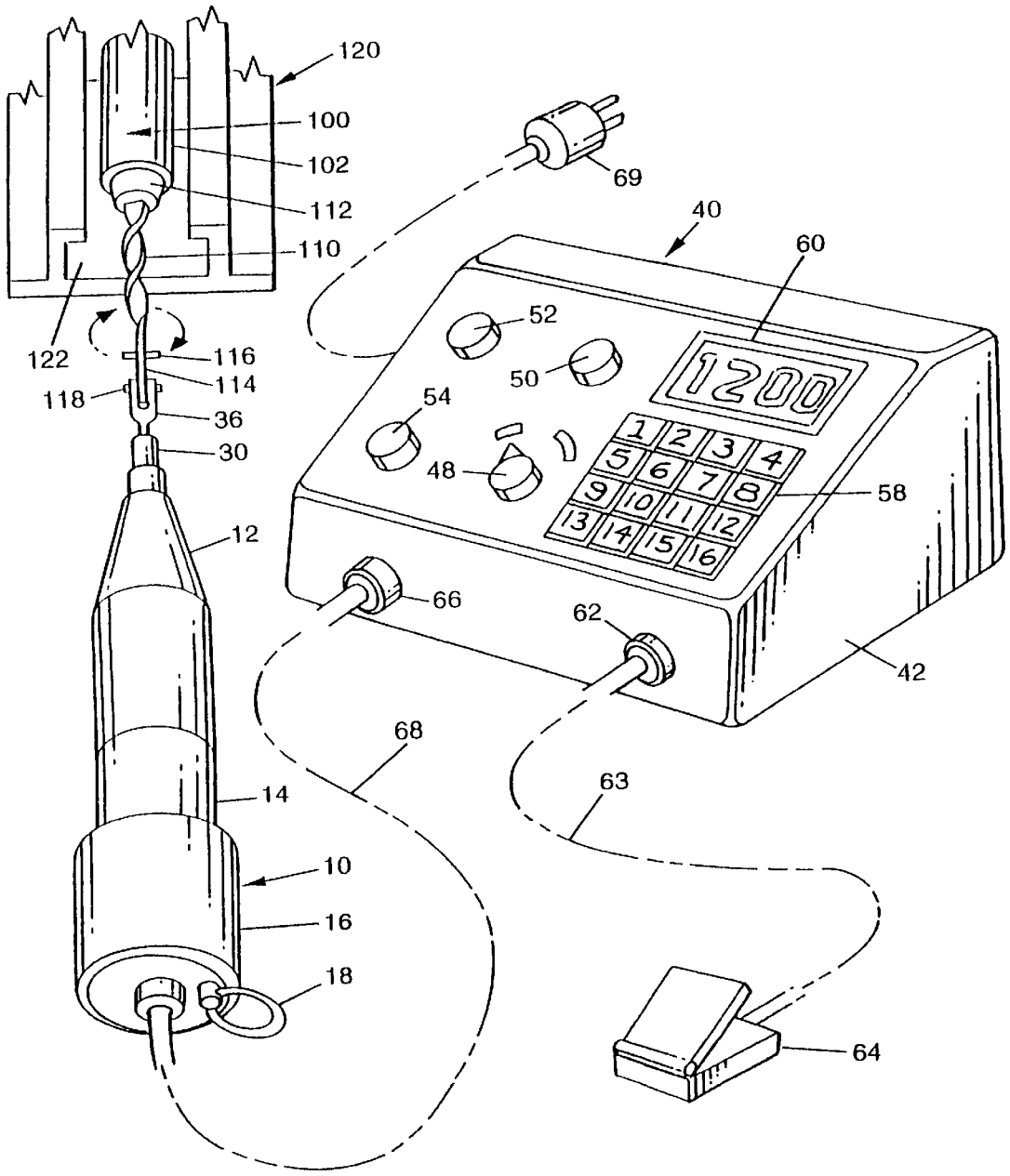
FIG. 1 is a perspective schematic view of the spring winder device of the present invention.

In greater detail, and referring to FIG. 1, there is shown a hand tool 10 connected to a control box assembly 40 by a power cable 68 and input power plug 66. A foot switch 64 is joined by a cable 63 and connector plug 62 to the control box assembly 40. The control box assembly 40 is connected to a source of power by input power plug 69 typically plugged into a 110 volt alternating current power source.

The hand tool 10 includes a handgrip housing 12 (typically knurled to facilitate gripping), a motor/gear box housing 14, and a motor cover 16. A suspension ring 18 is used to hang the hand tool from a hook when not in use. Alternatively, and preferably, the suspension ring 18 is connected to a spring retainer (not shown) which withdraws the hand tool 10 from proximity to the workpiece when released by the worker.

The control box assembly 40 comprises a housing 42 on which is shown a rotation direction switch 48, a mode switch 50, a power switch 52, a stop button 54, a keypad 58 and a digital display 60 such as an LED display. The keypad 58 is numbered from 1 to 15 to permit the operator to select the number of revolutions to be made by the hand tool 10 to provide a predetermined tension to a balance spring. The invention is not limited to this relatively small number of revolutions, but instead may use a keypad on which combinations of numbers can be programmed for fractional revolutions to hundreds of revolutions and higher.

The hand tool 10 includes a winder hook chuck 30 in which is inserted a slotted winder hook 36. The winder hook is shown engaging a torque winder rod 110. A flat straight retainer head 114 contains a retainer pin 116. It also contains an end pin 118 engaged by the winder hook 36. The winder hook 36 contains a slot 37 (shown in FIG. 4) which engages the torque winder rod 110 for imparting rotation thereto. The torque winder rod 110 is shown as part of a spiral balancer tube assembly 100 comprising a balancer tube 102 in a channel 122 of a window jamb 120. The winder rod 110 moves in an axial direction through a sleeve or cap 112 on the end of the balancer tube 102. The cap 112 typically is color coded as an indicia of the degree of spring tension in the balance spring.

Figure 2:
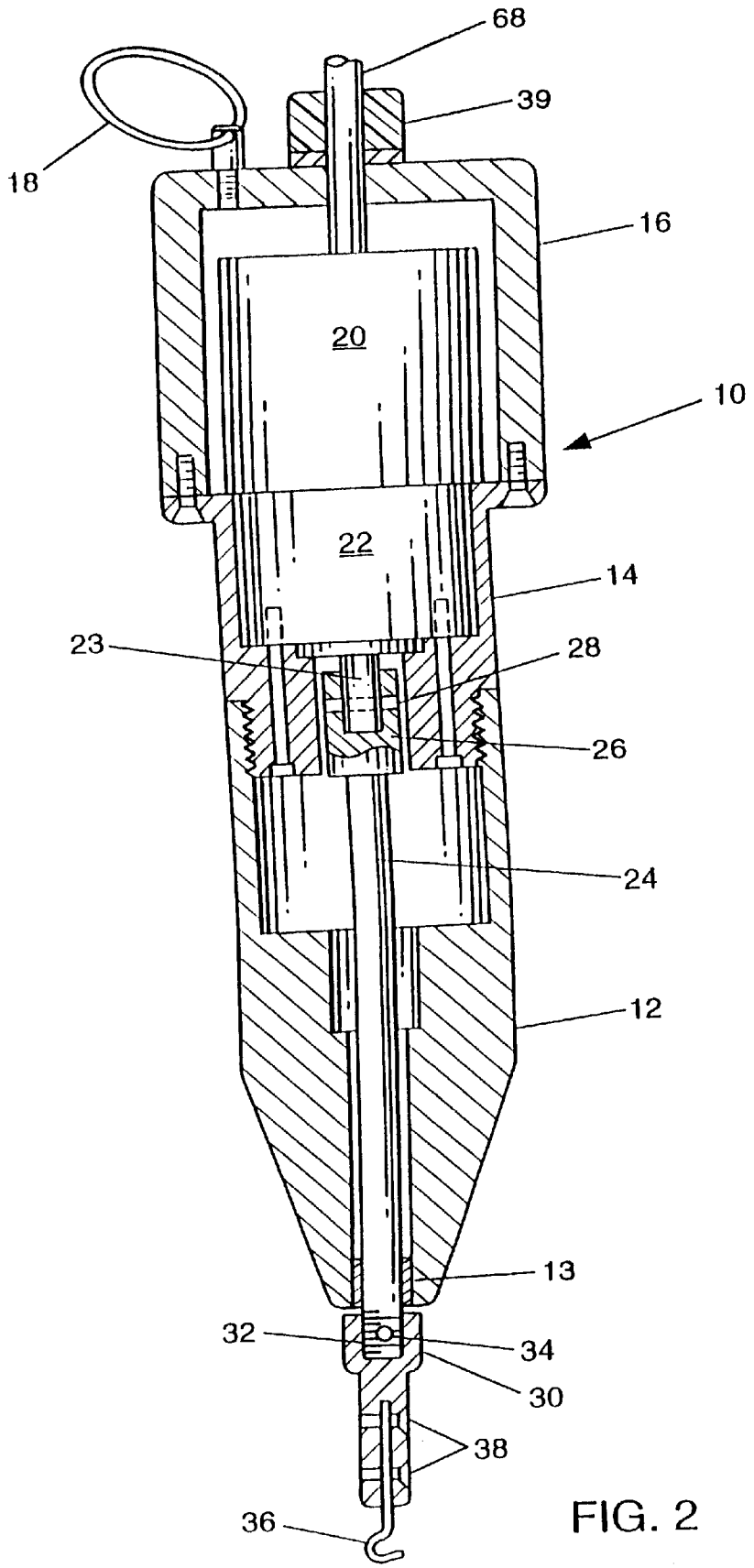
FIG. 2 is a sectional view of the spring winding tool of the present invention.

Referring now to FIG. 2, shown in greater detail is the hand tool 10. Within the motor cover 16 is a motor 20 and gearbox 22. A power cable 68 from the controller passes through a cord grip 39 into the housing 14 where it is electrically connected to the terminals of the motor 20. The output from the gearbox comprises a drive shaft 23 coupled to an extended shaft 24 using a coupler 26 and lock pin 28. The extended shaft 24 passes through a support bearing 13 at the end of the hand grip housing 12. The winder hook chuck 30 is screwed onto threads 32 at the end of extended shaft 24 and is held in place by chuck pin 34. Secured through the winder hook chuck 30 by screws 38 is the winder hook 36.

A motor that has been found to be satisfactory for the designated purpose of driving the hand tool 10 to apply tension to the torque winder rod 110 is an API Positran MTx-170. This is a step-motor which can deliver a no-load speed of 3000 RPM drawing a current of about 1 amp. This motor preferably is coupled to an API Positran reduction gearbox model IS40A having a reduction ratio of 5 to 1. The motor and gearbox are marketed by API Positran LDD, located in Kingwood Hampshire, United Kingdom.

Figure 3:
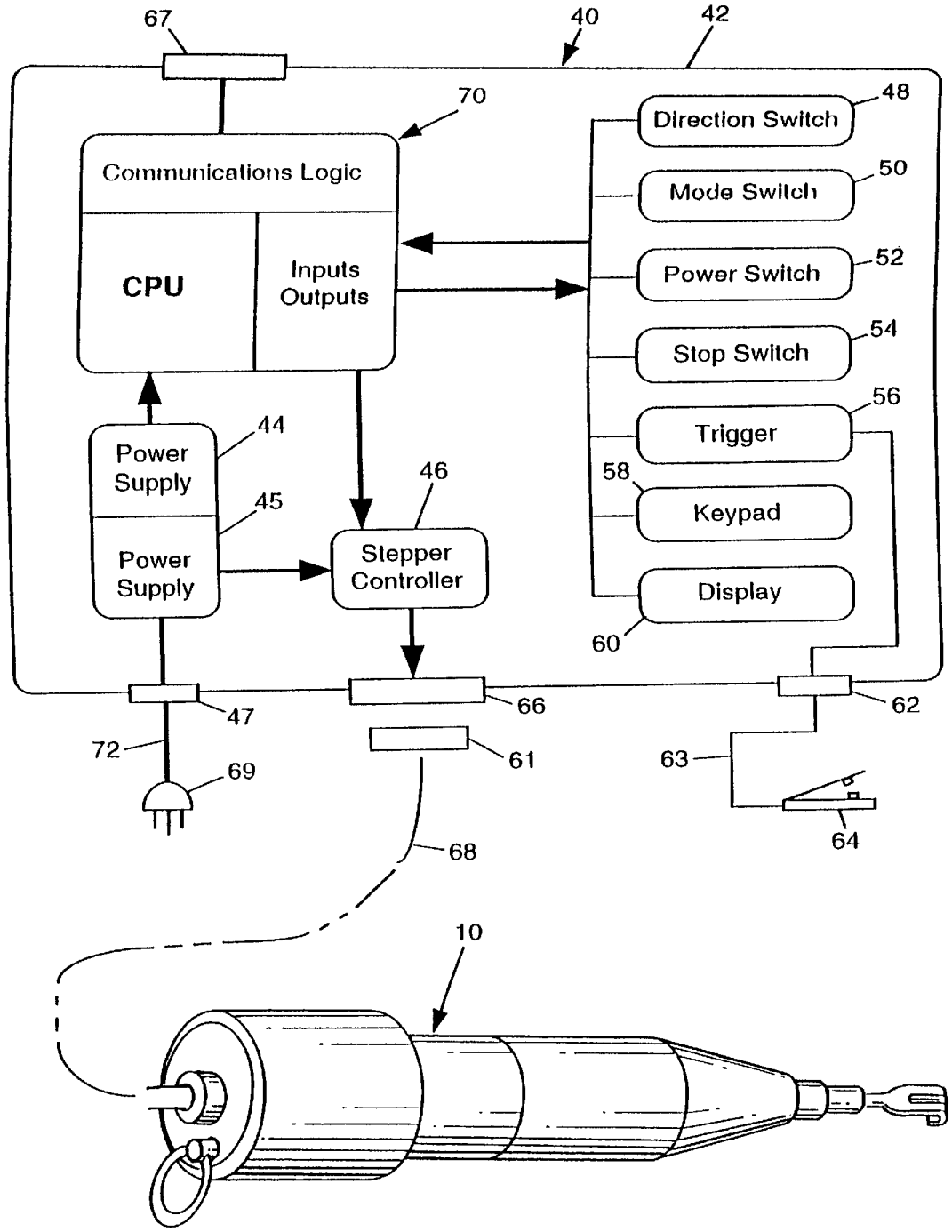
FIG. 3 is a block diagram of the stepper controller, with attached foot switch and spring winding tool.

Turning now to FIG. 3, a block diagram of the control box assembly 40 contained within housing 42 is shown. One end of the power supply line 72 is connected to an imput power plug 69. The other end of the power supply line 72 passes through cord grip 47 into the control box housing 42 through a suitable power supply 45 for a stepper controller 46 and a power supply 44 for the printed circuit board 70. This p.c. board contains a computer processing unit (CPU), inputs and outputs and a communications logic circuit.

The hand tool 10 is connected by the cable 68, plug 61 and connector 66 to the stepper controller 46. The stepper controller preferably is a 2 phase bipolar constant current recirculating microstepping controller/driver for step motors, using microstep resolutions up to 12,800 microsteps per revolution. A particularly suitable controller for the practice of the present invention is one sold by API (Controls Division), Amherst, N.Y., as the DM 224i Intelligent Microstepping Driver. Based upon the signal from the p.c. control board 70, the stepper controller 46 determines the direction and number of revolutions, the acceleration and deceleration, and the torque to be imparted by the hand tool 10 to a torque winder rod (not shown) and transmits a signal pattern to the hand tool with these parameters. For optimum torque, the controller is programmed to operate at less than 5000 microsteps and preferably less than 1000 microsteps per revolution. As the torque requirements increase, they are effectively handled within the parameters of the present invention by decreasing the number of microsteps which are employed per each revolution of the tool. The stepper controller 46 preferably is programmed to deliver a power step-down signal to the step motor after a predetermined period (e.g. 30 seconds) of idleness. This serves to increase the life expectancy of the motor. The controller also provides speed degradation at higher numbers of programmed revolutions. One other favorable feature of the stepper controller 46 is the ability to shut down the motor when it hits a peak current, thereby eliminating the possibility of the motor shorting out or burning up.

A foot switch 64 is linked through cable 63 to a receptacle plug 62 in the housing 42. The switch is connected to a trigger 56 which is also connected to a keypad 58 and display 60. When a number is digitally entered on the keypad, closing of the contact by the foot switch sends a signal to the imput of the main logic and control board 70 which in turn signals the stepper controller 46 to activate the tool and to rotate the winder hook a pre-determined number of revolutions in a given direction corresponding to the numeral display shown on the keypad 58. A foot switch can be chosen which will initiate the cycle by merely pressing and releasing the switch whereupon the tool will be activated for the entire cycle. Alternatively, a foot switch can be employed which must remain depressed by the foot throughout the entire cycle whereupon, if the switch is released before the cycle is completed, the controller can be programmed to automatically reset to zero or to retain the number of completed revolutions until the switch is again pressed to complete the cycle. The foot switch can be replaced by an alternative type of contact switch or even a voice activated device. A hand trigger switch mounted on the hand tool is also an option.

The directional switch 48, typically a simple toggle switch, determines the rotation of the tool in a clockwise or a counterclockwise direction. This allows for the application of torque to right or left handed coil springs, and also permits the operator to increase or decrease the torque on the coil spring at the discretion of the operator. Instead of using a reversible motor, a gearbox with a reversible direction clutch or gear arrangement can likewise be used.

The mode switch 50 serves to control whether the number of revolutions entered on the keypad will be repeated each time the foot switch is actuated, or whether the display will automatically reset to zero, thereby requiring the manual entry of a new number into the keypad prior to each operating cycle of the tool. The power switch 52 serves the usual and customary purpose of activating the device preparatory to use, and shutting off power to the device when not in use. The communication connection 67 permits the controller to exchange information with another computer. For example, a central computer can be used to control multiple work stations, each of which is equipped with one of these devices. In addition, information relating to production rates, etc. can be fed from each controller to the computer for inventory and for quality and production control and analysis.

Although the device of the present invention is designed for use in connection with the fabrication of double hung windows, its use is not limited to this singular application. Instead, the control and tool can be used in other applications in which a repeatable cycle of pre-selected rotations are required as an integral step in a fabricating or assembly operation.

Figure 4:
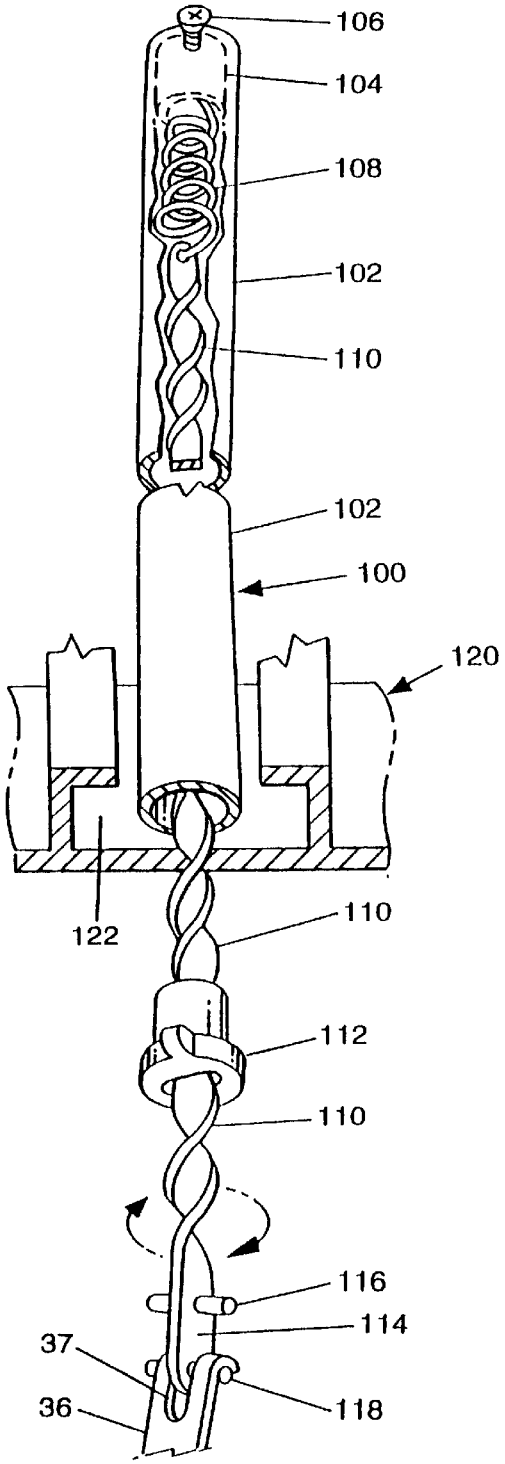
FIG. 4 is a perspective view of a spiral balancer tube assembly with partial view of a window jamb and torque winding rod.
Figure 5:
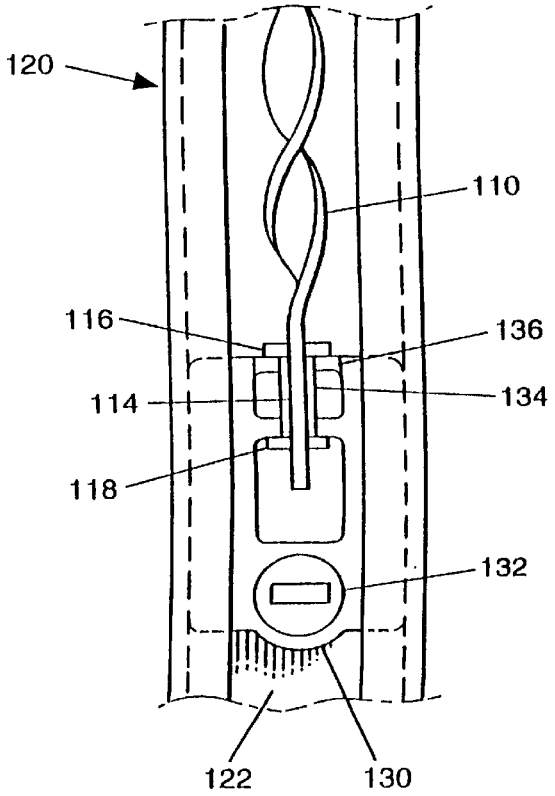
FIG. 5 is a partial view showing the window jamb with the end of the torque winding rod retained in a balance shoe assembly.

FIG. 4 shows, partially in cross-section, the use of the winder hook 36 to apply tension through the torque winder rod 110, which in turn increases or decreases tension on a coil spring 108. The coil spring 108 is held in a spring retainer 104 secured to the end of the balancer tube 102, by screw 106. The winder rod 110 passes through a color-coded sleeve 112. The retainer head 114 of the winder rod 110 is received in the slot 37 of the winder hook 36 and the winder hook engages the end pin 118 on the retainer head 114. The tube assembly 100 is located within the channel 122 in the window jamb 120. FIG. 5 shows a balance shoe assembly 130 held in place within the balance tube channel 122 of jamb 120 by rotation of a locking cam 132. A retainer slot 134 and metal retainer plate 136 are adapted to receive the retainer pin 116. The retainer pin is held in the retainer slot by the tension exerted by the coil spring against the torque winder rod 110.

Figure 6:
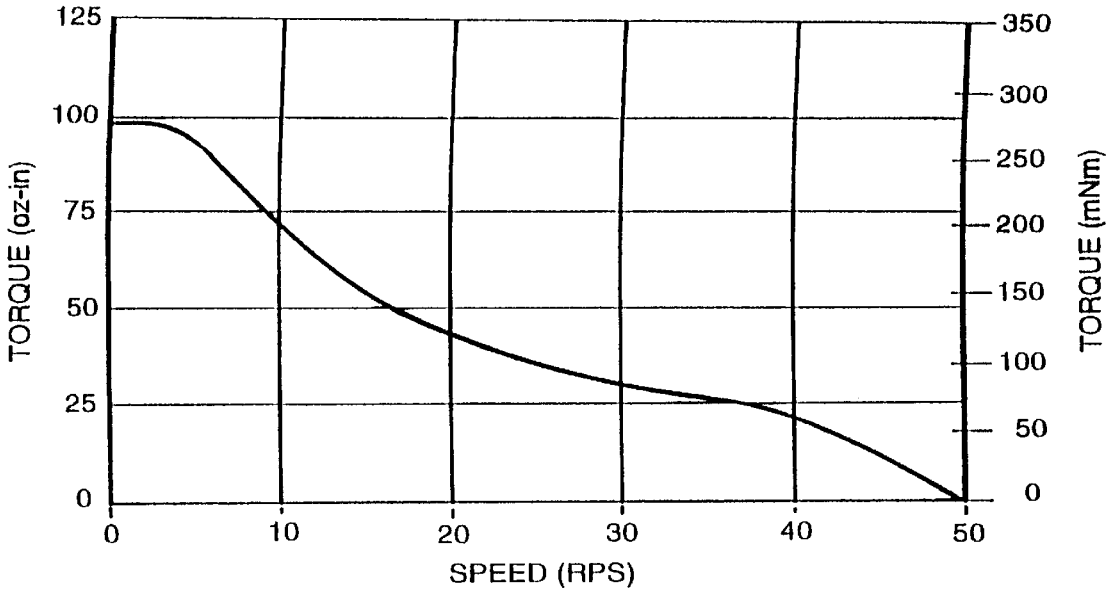
FIG. 6 is a curve of the torque vs. acceleration characteristics of the winder tool motor.

FIG. 6 is a typical torque curve for the step motor, and represents the torque characteristics which are deemed to be highly suitable for applying tension to the coil of a balancer spring. The high motor torque output on the order of about 100 oz.-in. at startup permits the motor to accelerate smoothly to normal operating speed. As the speed increases, the torque decreases to near zero at 50 rpm where the speed is clamped by the stepper controller. Of course, it is understood that the speed can be clamped at slower or faster revolutions per minute as needed.

Figure 7:
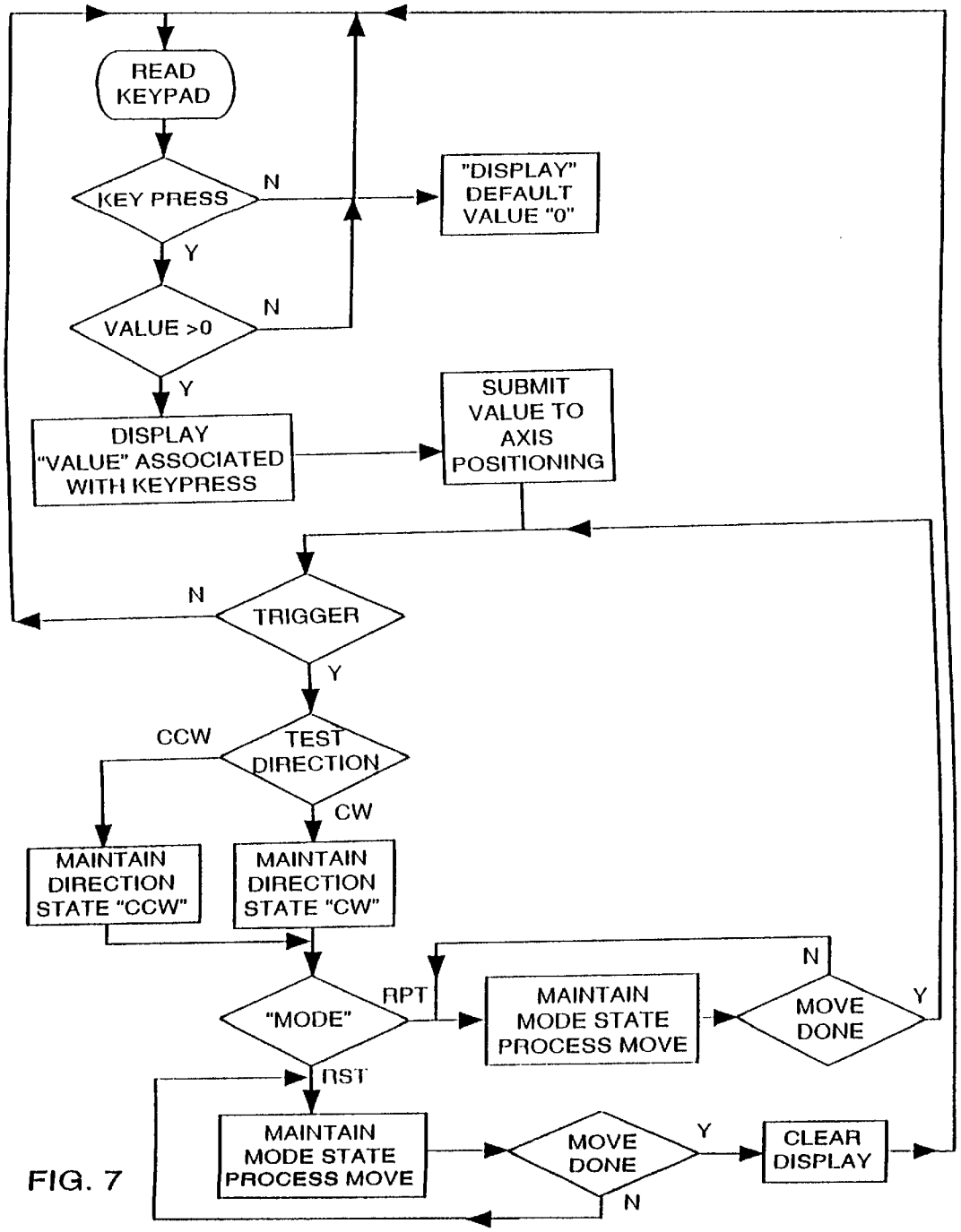
FIG. 7 is a process flow diagram of the stepper controller.

FIG. 7 illustrates the literal program flow and loop program execution to maintain a non-interrupt driver program and is self explanatory to one skilled in the art.

Although a stepper controller is used to control the operation of an electric motor, the invention can likewise be used with pneumatic or hydraulic means and a series of servo valves to drive and control the rotary hand tool. There are numerous other variations and adaptations that can be used in connection with the device of the present invention. For example, the hand tool can be programmed for a variety of repetitive moves in a predetermined sequence or in a sequence which varies from a spring used on one side of a window to the spring used on the other side. The sequence can be displayed on a monitor or a digital display, and can be changed by keystroke entries, verbal commands or the like. The device can be programmed to read bar codes placed on the balance springs, sashes or other component parts of a window system, and to then make adjustments in the torque, number of revolutions, the direction of rotation or other parameters base on the information scanned from the bar codes.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

What is claimed is:

1. A device for delivering a uniformly reproducible number of rotations to a coil spring comprising:

a) a hand tool comprising a step motor, a speed reducer and means for engaging and turning a free end of the coil spring relative to a fixed end to vary the tension on the spring;

b) a programmable stepper controller coupled to the hand tool for controlling the operating parameters thereof and for driving the step motor at less than 5000 microsteps per revolution of the step motor;

c) means to impart instructions to the controller relative to the number of revolutions to be applied to the free end of the coil spring, and d) means for activating the hand tool pursuant to the instructions imparted to the controller.

2. The device a according to claim 1 wherein the means for engaging the free end of the coil spring comprises a slotted winder hook.

3. The device according to claim 1 wherein the stepper controller drives the step motor at less than 1000 microsteps per revolution of the step motor.

4. The device according to claim 1 wherein the stepper controller includes a step-down signal means following a predetermined period of idleness of the hand tool.

5. The device according to claim 1 wherein the stepper controller includes means to provide speed degradation of the step motor as the number of programmed revolutions increases.

6. The device according to claim 1 wherein the stepper controller includes means to shut down the hand tool motor at peak current.

7. The device according to claim 1 wherein the programmable controller includes a numeric keypad for manually entering instructions relative to the number of revolutions to be imparted to a coil spring by the hand tool.

8. The device according to claim 1 wherein the programmable controller includes a directional switch to control the direction of rotation of the coil engaging means.

9. The device according to claim 1 wherein the programmable controller includes a mode selection switch for zero reset or for repeat operation after each sequence of the winder tool.

10. The device according to claim 1 wherein the means for activating the hand tool comprises a foot switch.

11. A programmable device for applying tension to a balancer spring assembly of the type used in connection with a double-hung window system, the device comprising:

a) a hand tool including a step-motor having a no load speed of approximately 3000 r.p.m., a speed reducer coupled to the motor and having a reduction ratio of about 5 to 1, a chuck for holding a slotted winder hook, and a winder hook held in the chuck;

b) a programmable stepper controller coupled to the hand tool and comprising a numeric keypad for entering a predetermined number of revolutions to be imparted to the winder hook, a rotation direction selector, a mode selection means to select between zero reset and repeat operation after a given cycle, and c) a hand tool activator comprising a foot petal.

12. The device according to claim 11 wherein the stepper controller drives the step motor at less than 1000 microsteps per revolution of the step motor.

13. The device according to claim 12 wherein the stepper controller includes a step-down signal means following a predetermined period of idleness of the hand tool.

14. The device according to claim 12 wherein the stepper controller includes means to provide speed degradation of the step motor as the number of programmed revolutions increases.

15. The device according to claim 12 wherein the stepper controller includes means to shut down the hand tool motor at peak current.

16. A device for delivering a uniformly reproducible number of rotations to a coil spring comprising:

a) a hand tool comprising a motor, a speed reducer and means for engaging and turning a free end of the coil spring relative to a fixed end to vary the tension on the spring, the motor comprises a step-motor having a no-load speed of approximately 3000 r.p.m. and the speed reducer has a reduction ratio of approximately 5/1;

b) a programmable controller coupled to the hand tool for controlling the operating parameters thereof;

c) means to impart instructions to the controller relative to the number of revolutions to be applied to the free end of the coil spring, and d) means for activating the hand tool pursuant to the instructions imparted to the controller.

17. The use of a programmable device for delivering a uniformly reproducible number of rotations to a balancer spring assembly comprising a) employing a hand tool including a step-motor having a no load speed of approximately 3000 r.p.m., a speed reducer coupled to the motor and having a reduction ratio of about 5 to 1, a chuck for holding a slotted winder hook, and a winder hook held in the chuck;

b) utilizing a programmable stepper controller coupled to the hand tool and comprising a numeric keypad for entering a predetermined number of revolutions to be imparted to the winder hook, a rotation direction selector, and a mode selection means to select between zero reset and repeat operation after a given cycle, and c) activating a hand tool activator utilizing a foot petal.

18. The use of the device according to claim 17 wherein the stepper controller drives the step motor at less than 1000 microsteps per revolution of the step motor.

19. The use of the device according to claim 18 wherein the stepper controller includes a step-down signal means following a predetermined period of idleness of the hand tool.

20. The use of the device according to claim 18 wherein the stepper controller includes means to provide speed degradation of the step motor as the number of programmed revolutions increases.

21. The use of the device according to claim 18 wherein the stepper controller includes means to shut down the hand tool motor at peak current.

* * * * *